US006050732A

United States Patent [19]

Tsusaka

[11] Patent Number: 6,050,732

[45] Date of Patent: Apr. 18, 2000

[54] DOUBLE-SIDE PRINTING CONTROL METHOD

[75] Inventor: Masaki Tsusaka, Kanagawa, Japan

[73] Assignee: Ricoh Company, Ltd., Tokyo, Japan

[21] Appl. No.: 09/241,065

[22] Filed: Feb. 1, 1999

[30] Foreign Application Priority Data

Feb. 2, 1998 [JP] Japan ..... 10-021022

[51] Int. Cl.[7] ..... B41J 11/44

[52] U.S. Cl. ..... 400/76; 400/70; 400/61

[58] Field of Search ..... 400/76, 70, 63, 400/61, 188; 395/114

[56] References Cited

U.S. PATENT DOCUMENTS

| | | | |
|---|---|---|---|
| 5,737,503 | 4/1998 | Mitani | 395/115 |
| 5,872,900 | 2/1999 | Tsuchitoi | 395/111 |
| 5,905,853 | 5/1999 | Murakami | 395/115 |
| 5,918,088 | 6/1999 | Rikima | 399/82 |
| 5,920,686 | 7/1999 | Mitani | 395/115 |

FOREIGN PATENT DOCUMENTS 9-193481 7/1997 Japan .

*Primary Examiner*—John S. Hilten
*Assistant Examiner*—Charles H. Nolan, Jr.
*Attorney, Agent, or Firm*—Oblon, Spivak, McClelland, Maier & Neustadt, P.C.

[57] ABSTRACT

In a double-side printing control method, a printing request transmitted by a host computer is received, the printing request including print data and a given resolution of the print data. The print data is expanded to image data at the given resolution. The image data is stored in a system control part of a printing apparatus. A double-side printing is performed with the stored image data when the printing request is a double-side printing request. Before performing the double-side printing at the given resolution, it is determined whether an image memory area of the system control part that stores two pages of image data is held, and it is determined whether an image memory area of an external storage part that stores one page of image data can be held.

7 Claims, 4 Drawing Sheets

DOUBLE-SIDE PRINTING CONTROL METHOD

BACKGROUND OF THE INVENTION (1) Field of the Invention

The present invention relates to a double-side printing control method which is appropriate for an image forming apparatus having an integrated capability that enables the image forming apparatus to carry out one of copier, printer and facsimile functions.

(2) Description of the Related Art

As disclosed in Japanese Laid-Open Patent Application No.9-193481, a printing apparatus which carries out a double-side printing is known. The printing apparatus of the above publication is provided with a main page buffer and a count data memory. In the main page buffer, print data is expanded to image data and the image data is stored. In the count data memory, count data related to the print data is stored. When the double-side printing is carried out, the image data retained by the main page buffer is printed on both sides of each copy.

In the printing apparatus of the above publication, a secondary page buffer is provided in addition to the main page buffer and the count data memory. If the main page buffer lacks a capacity to store an amount of image data that exceeds an amount of image data corresponding to two pages during the double-side printing, the excess image data that is not stored in the main page buffer is temporarily stored in the secondary page buffer.

Alternatively, in the printing apparatus of the above publication, a receiving buffer may be provided in addition to the main page buffer and the count data memory. When print data is transmitted to the printing apparatus by a host computer, the print data is received at the receiving buffer and it is retained by the receiving buffer. If the main page buffer lacks a capacity to store an amount of image data exceeding the amount of image data corresponding to two pages during the double-side printing, the outputting of the excess image data to the main page buffer is delayed until the print data retained by the receiving buffer is expanded to image data.

In the above-described manner, the printing apparatus of the above publication makes it possible that the host computer transmit a double-side printing request to the printing apparatus without taking account of the internal construction of the printing apparatus. The printing apparatus of the above publication is intended to achieve an efficient, speedy double-side printing even when the printing apparatus is requested by the host computer to perform a double-side printing of plural copies.

Generally, when performing the double-side printing, it is necessary to hold an image memory area of a printing apparatus that stores image data the amount of which corresponds to two pages (or both sides of a copy). This enables the recovery of the image data when a paper jam or the like occurs in the printing apparatus during the printing of the image data for the front side of a copy. If the printing apparatus holds the image memory area during the double-side printing, the image data corresponding to two pages can be recovered by accessing the image memory area in such a case.

However, the amount of image data produced by the expansion of print data and stored in the image memory area varies depending on a given resolution of the print data sent by the host computer. When a certain resolution is set with the print data, the printing apparatus of the above publication may not hold the image memory area which store the image data the amount of which corresponds to two pages. If the printing apparatus of the above publication stores only an amount of image data corresponding to one page and a paper jam or the like occurs during the double-side printing, it is impossible to recover the image data corresponding to two pages by accessing the image memory area. Retransmission of the print data to the printing apparatus by the host computer is required to recover the image data corresponding to two pages.

Further, when performing an interleave printing, an alternate double-side printing of plural copies is performed for the front side of a first copy, the front side of a second copy, the back side of the first copy, the back side of the second copy, etc., in this sequence. On the other hand, when the normal double-side printing is performed by a conventional printing apparatus having an external storage part, print data for both sides of a first copy, print data for both sides of a second copy, etc., are sequentially expanded to image data and it is stored in the external storage part. The speed of the regular double-side printing (which depends on the speed of the expanding of the print data and the storing of the image data in the external storage part) by the conventional printing apparatus is not always higher than the speed of the interleave printing. In a case in which the speed of the regular double-side printing is lower than the speed of the interleave printing, it is difficult for the conventional printing apparatus to achieve an efficient, speedy printing.

SUMMARY OF THE INVENTION

An object of the present invention is to provide an improved double-side printing control method in which the above-described problems are eliminated.

Another object of the present invention is to provide a double-side printing control method which is effective in holding an image memory area of the printing apparatus that stores two pages of image data, when performing the double-side printing at a given resolution of the print data.

The above-mentioned objects of the present invention are achieved by a double-side printing control method executed by a printing apparatus including a system control part and an external storage part, the method comprising the steps of: receiving a printing request transmitted by a host computer, the printing request including print data and a given resolution of the print data; expanding the print data to image data at the given resolution; storing the image data in the system control part; performing a double-side printing with the stored image data when the printing request is a double-side printing request; determining, before performing the double-side printing at the given resolution, whether an image memory area of the system control part that stores two pages of image data is held; and determining, before performing the double-side printing at the given resolution, whether an image memory area of the external storage part that stores one page of image data can be held.

According to the double-side printing control method of the present invention, it is possible to safely recover the image data corresponding to two pages by accessing the image memory areas when a paper jam or the like occurs on the printing apparatus during the double-side printing. It is not necessary to perform the retransmission of the print data from the host computer to the printing apparatus as required by the conventional printing apparatus when a paper jam occurs during the double-side printing.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF THE PREFERRED EMBODIMENTS

A description will now be given of the preferred embodiments of the present invention with reference to the accompanying drawings.

Figure 1:
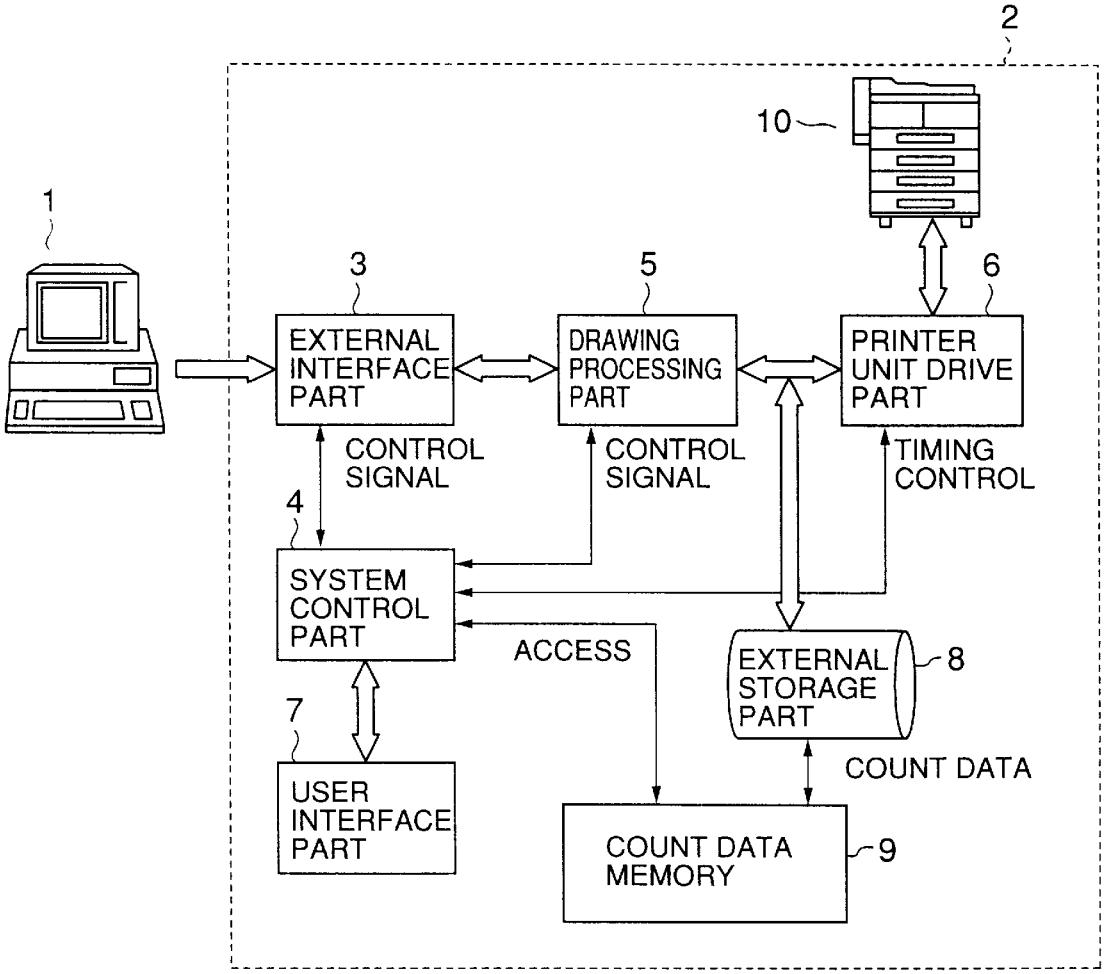
FIG. 1 is a block diagram of a printing apparatus which executes a double-side printing control method of the present invention.

FIG. 1 shows a configuration of a printing apparatus 2 which executes a double-side printing control method of the present invention. Hereinafter, the printing apparatus 2 of FIG. 1 will be described as a typical example of an image forming apparatus having an integrated capability that enables the image forming apparatus to carry out one of copier, printer and facsimile functions.

As shown in FIG. 1, a host computer 1 is connected to an input of the printing apparatus 2 in the present embodiment. The host computer 1 is an external data source which transmits print data to the printing apparatus 2. The printing apparatus 2 carries out the double-side printing, and includes a printer unit 10 which is capable of performing an interleave printing procedure.

In the printing apparatus 2 of FIG. 1, an external interface part 3 provides an interface between the printing apparatus 2 and the host computer 1, and receives a printing request, including print data, transmitted to the printing apparatus 2 by the host computer 1. A system control part 4 controls the entire printing apparatus 2, and has an image memory area for storing image data the amount of which corresponds to two pages. A drawing processing part 5 expands the print data, received at the external interface part 3, to image data in accordance with a control signal sent by the system control part 4. A printer unit drive part 6 controls the printer unit 10 to perform printing in accordance with a timing control signal sent by the system control part 4. A user interface part 7 includes a control panel (not shown) at which user's settings for the printing apparatus 2 are input to the system control part 4. An external storage part 8 has an image memory area for storing image data the amount of which corresponds to at least one page. A count data memory 9 is connected to the system control part 4 and stores count data (for example, the number of pages) related to the image data stored in the external storage part 8.

In the printing apparatus 2 of FIG. 1, the external storage part 8 may be constructed by a hard disk drive (HDD) having a large storage capacity and providing a high speed access. The system control part 4 may be constructed by a central processing unit (CPU) having a main memory.

Figure 2:
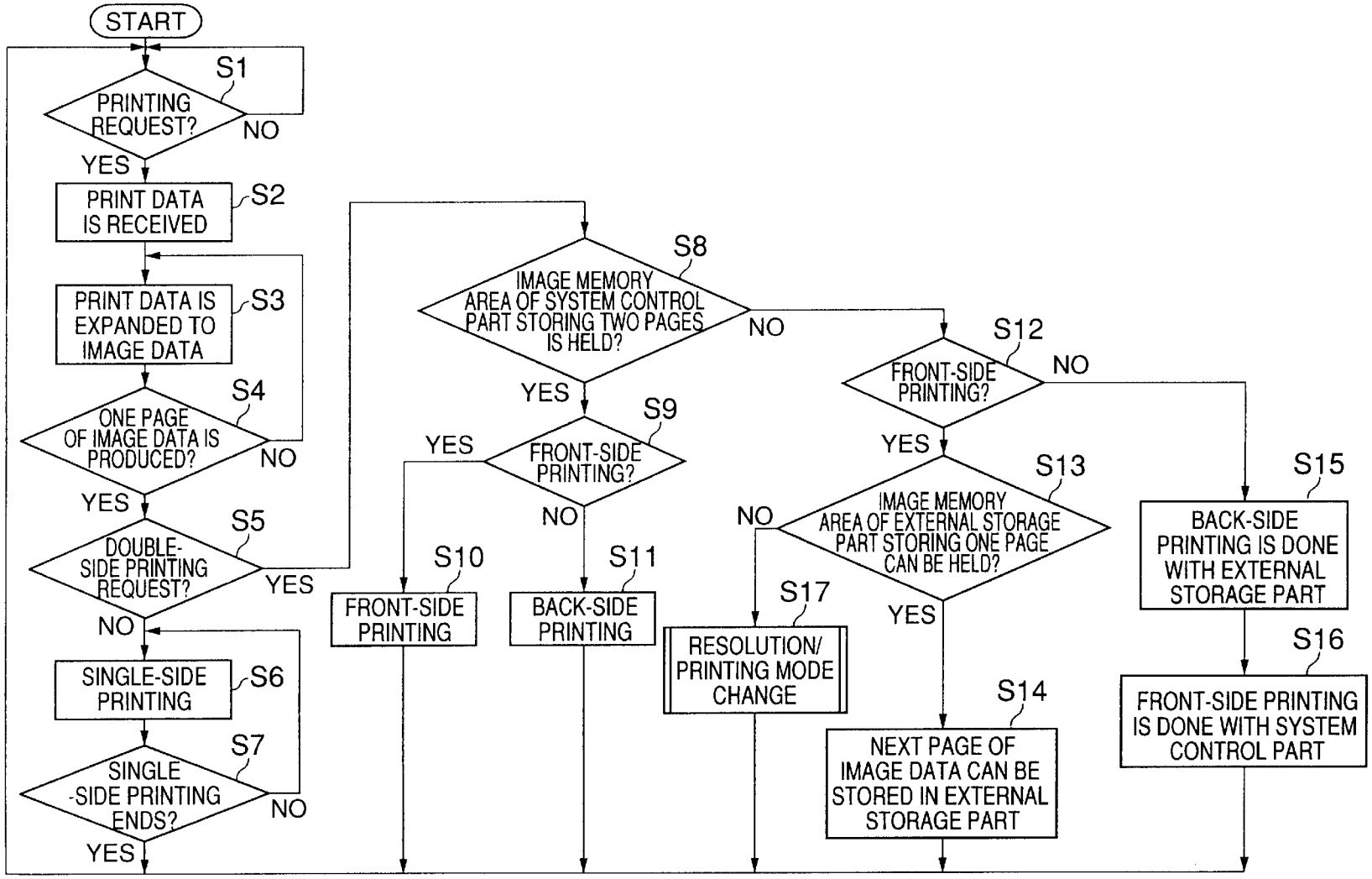
FIG. 2 is a flowchart for explaining an embodiment of a double-side printing control method of the present invention performed by the printing apparatus of FIG. 1.

FIG. 2 shows an embodiment of the double-side printing control method of the present invention which is executed by the printing apparatus of FIG. 1.

As shown in FIG. 2, at a start of the double-side printing control process, the system control part 4 at step S1 determines whether a printing request, including print data, transmitted by the host computer 1 is received at the external interface part 3. When the result at the step S1 is negative, the control of the system control part 4 is transferred to the step S1.

When the result at the step S1 is affirmative, the system control part 4 at step S2 controls the external interface part 3 so that the print data sent by the host computer 1 is received at the external interface part 3. After the step S2 is performed, the system control part 4 at step S3 controls the drawing processing part 5 so that the print data, received at the external interface part 3, is expanded to image data by the drawing processing part 5. The resulting image data is stored in the image memory area of the system control part 4.

After the step S3 is performed, the system control part 4 at step S4 determines whether one page of image data is already produced by the expansion of the print data by the drawing processing part 5. When the result at the step S4 is negative, the control of the system control part 4 is transferred to the step S3.

When the result at the step S4 is affirmative, the system control part 4 at step S5 determines whether the printing request, received at the external interface part 3, is a double-side printing request.

When the result at the step S5 is negative (or a single-side printing request), the system control part 4 at step S6 controls the printer unit drive part 6 so that a single-side printing is performed by the printer unit 10 to print the image data on the front side of a copy.

The system control part 4 at step S7 determines whether the single-side printing is terminated by the printer unit 10. When the result at the step S7 is negative, the control of the system control part 4 is transferred to the step S6. When the result at the step S7 is affirmative, the control of the system control part 4 is transferred to the step S1.

When the result at the step S5 is affirmative (or the double-side printing request), the system control part 4 at step S8 determines whether an image memory area of the system control part 4 that stores two pages of image data is held.

When the result at the step S8 is affirmative (or when the image memory area storing two pages of image data is held), the system control part 4 at step S9 determines whether the front-side printing of a copy is processed with the stored image data.

When the result at the step S9 is affirmative (or the front-side printing), the system control part 4 at step S10 controls the printer unit drive part 6 so that the front-side printing is performed by the printer unit 10 to print the image data on the front side of the copy. After the step S10 is performed, the control of the system control part 4 is transferred to the step S1.

When the result at the step S9 is negative (or the back-side printing), the system control part 4 at step S11 controls the printer unit drive part 6 so that the back-side printing is performed by the printer unit 10 to print the image data on the back side of the copy. After the step S11 is performed, the control of the system control part 4 is transferred to the step S1.

On the other hand, when the result at the step S8 is negative (or when only an image memory area storing one page of image data is held), the system control part 4 at step S12 determines whether the front-side printing of a copy is processed with the stored image data.

When the result at the step S12 is affirmative (or the front-side printing), the system control part 4 at step S13 determines whether an image memory area of the external storage part 8 storing one page of image data can be held.

When the result at the step S13 is affirmative, the system control part 4 at step S14 controls the drawing processing part 5 so that the next page of image data produced by the expansion of the print data by the drawing processing part 5 can be stored in the image memory area of the external storage part 8. After the step S14 is performed, the control of the system control part 4 is transferred to the step S1.

When the result at the step S13 is negative, the system control part 4 at step S17 performs a resolution/printing mode changing procedure (which will be described later with reference to FIG. 3). After the step S17 is performed, the control of the system control part 4 is transferred to the step S1.

On the other hand, when the result at the step S12 is negative (or the back-side printing), the system control part 4 at step S15 controls the printer unit drive part 6 so that the back-side printing is performed by the printer unit 10 to print the image data (which is output from the image memory area of the system control part 4) on the back side of the copy. After the step S15 is performed, the system control part 4 at step S16 controls the printer unit drive part 6 so that the front-side printing is performed by the printer unit 10 to print the image data (which is output from the image memory area of the external storage part 8) on the front side of the copy. After the step S16 is performed, the control of the system control part 4 is transferred to the step S1.

Accordingly, when performing the double-side printing with a given resolution of the print data, the above-described embodiment of the double-side printing control method according to the present invention is effective in holding the image memory areas of the system control part 4 and the external storage part 8 that store two pages of image data. It is possible to safely recover the image data corresponding to two pages by accessing the image memory areas when a paper jam or the like occurs during the double-side printing. It is not necessary to perform the retransmission of the print data from the host computer to the printing apparatus as required by the conventional printing apparatus when a paper jam occurs during the double-side printing.

Figure 3:
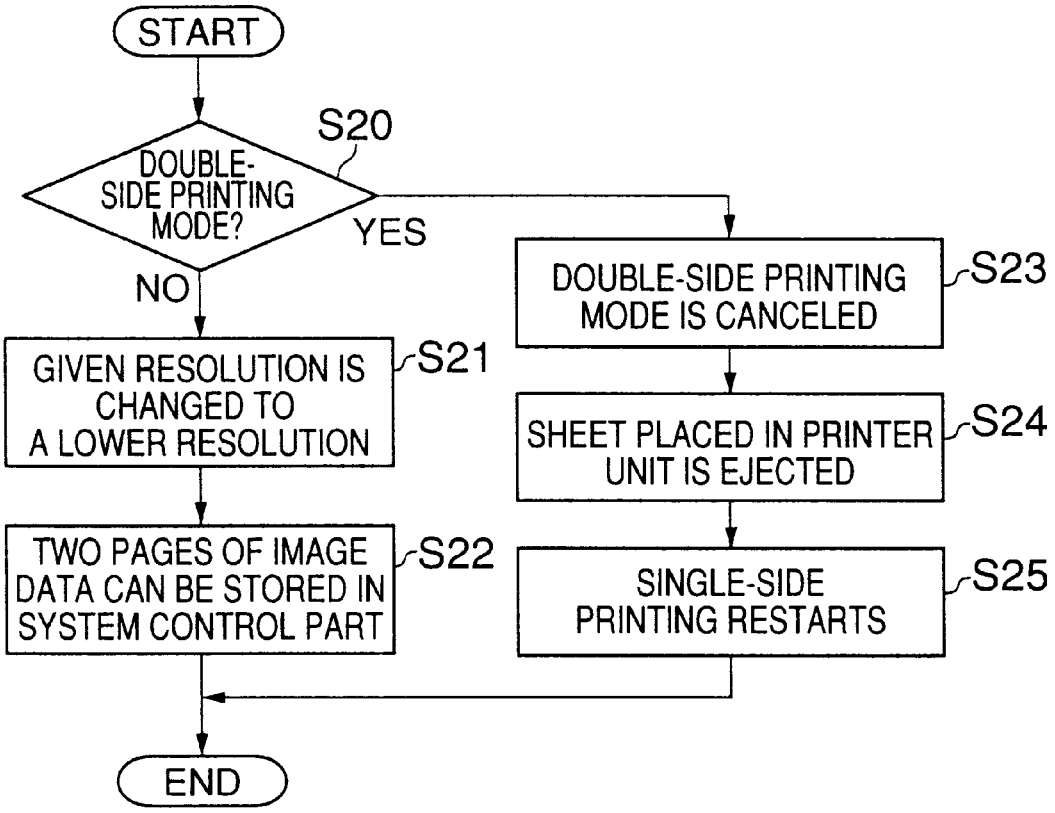
FIG. 3 is a flowchart for explaining an resolution/printing mode changing procedure in the double-side printing control process of FIG. 2.

FIG. 3 shows a resolution/printing mode changing procedure in the double-side printing control process of FIG. 2.

As described above, the resolution/printing mode changing procedure is performed by the system control part 4 when the result at the step S13 of FIG. 2 is negative (or when the image memory area of the external storage part 8 storing one page of image data cannot be held).

As shown in FIG. 3, at a start of the resolution/printing mode changing procedure, the system control part 4 at step S20 determines whether the printing apparatus 2 is currently set in a double-side printing mode. In the present embodiment, when a user's setting of the double-side printing mode is previously input at the user interface part 7 to the system control part 4, the printing apparatus 2 is set in the double-side printing mode. Alternatively, the printing apparatus 2 may be automatically set in the double-side printing mode when a given resolution of the print data is lower than a permissible resolution level (for example, 300 dpi).

When the result at the step S20 is negative (or when the printing apparatus 2 is set in a single-side printing mode), the system control part 4 at step S21 changes the given resolution to a new resolution. The new resolution may be predetermined to be one-rank lower than the given resolution. The expansion of the print data to image data at the new resolution by the drawing processing part 5 will allow the image memory area of the system control part 4 storing two pages of image data to be held.

After the step S21 is performed, the system control part 4 at step S22 controls the drawing processing part 5 with the new resolution so that two pages of image data produced by the expansion of the print data can be stored in the image memory area of the system control part 4. After the step S22 is performed, the resolution/printing mode changing procedure of FIG. 3 ends.

On the other hand, when the result at the step S20 is affirmative (or when the printing apparatus 2 is set in the double-side printing mode), the system control part 4 at step S23 cancels the double-side printing mode of the printing apparatus 2. The system control part 4 at step S24 controls the printer unit drive part 6 so that a sheet placed in the printer unit 10 is ejected out of the printer unit 10. The system control part 4 at step S25 controls the printer unit drive part 6 so that the printer unit 10 restarts performing a single-side printing to print the image data on the front side of a copy. After the step S25 is performed, the resolution/printing mode changing procedure of FIG. 3 ends.

According to the above-described procedure of FIG. 3, when only the image memory area of the system control part 4 storing one page of image data is held and an image memory area of the external storage part 8 storing one page of image data cannot be held, the given resolution of the print data is changed to a lower resolution or the double-side printing mode is changed to the single-side printing mode. It is possible for the above-described procedure of FIG. 3 to safely prevent the double-side printing from being stopped due to lack of the image memory area of the printing apparatus.

Figure 4:
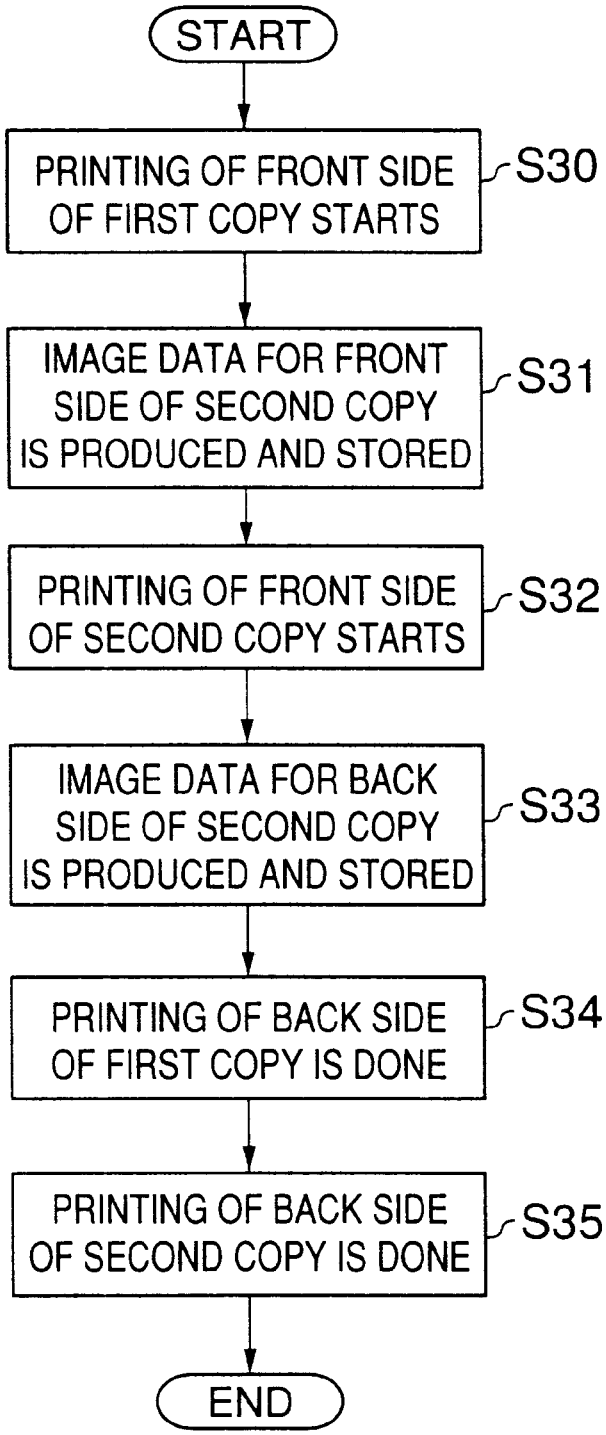
FIG. 4 is a flowchart for explaining an interleave printing procedure performed by the printing apparatus of FIG. 1.

Next, FIG. 4 shows an interleave printing procedure performed by the printing apparatus 2 of FIG. 1.

In order to enable the printing apparatus 2 to execute the interleave printing in the double-side printing control process, it is necessary to modify some of the steps of the flowchart of FIG. 2. In the present embodiment, the steps S13 through S17 of the flowchart of FIG. 2 are replaced by the steps of the flowchart of FIG. 4 in order to enable the execution of the interleave printing.

Further, in the present embodiment, before performing the double-side printing at a given resolution of the print data, the system control part 4 determines whether the interleave printing should be performed based on a time count needed for the drawing processing part 5 to expand the print data to image data at the given resolution. For example, the system control part 4 at the step S3 or the step S4 of the flowchart of FIG. 2 detects a time count needed for the drawing processing part 5 to expand the print data to image data at the given resolution. When the detected time count is larger than a reference time count that is previously set as being equivalent a processing time for the execution of the interleave printing, the system control part 4 determines that the interleave printing should be performed by the printer unit 10.

Further, in the present embodiment, in order to enable the execution of the interleave printing, it is necessary that an image memory area of the external storage part 8 that stores at least four pages of image data is held. For this reason, the steps S13 and S14 of the flowchart of FIG. 2 may be modified such that the system control part 4 at the step S13 determines whether an image memory area of the external storage part 8 storing at least four pages of image data can be held, and at the step S14 controls the drawing processing part 5 so that the next four pages of image data produced by the expansion of the print data can be stored in the image memory area of the external storage part 8.

In the present embodiment, when the result at the step S12 of the flowchart of FIG. 2 is affirmative (or the front-side printing), the system control part 4 starts performing the interleave printing procedure of FIG. 4. As shown in FIG. 4, the system control part 4 at step S30 controls the printer unit drive part 6 so that the printer unit 10 starts the printing of the front-side of a first copy.

During the printing of the step S30, the system control part 4 at step S31 controls the drawing processing part 5 so that the print data is expanded to image data for the front side of a second copy, and the image data is stored in the image memory area of the external storage part 8.

After the step S31 is performed, the system control part 4 at step S32 controls the printer unit drive part 6 so that the printer unit 10 starts the printing of the front-side of the second copy.

During the printing of the step S32, the system control part 4 at step S33 controls the drawing processing part 5 so that the print data is expanded to image data for the back side of the second copy, and the image data is stored in the image memory area of the external storage part 8.

After the step S33 is performed, the system control part 4 at step S34 controls the printer unit drive part 6 so that the printer unit 10 performs the printing of the back-side of the first copy.

After the step S34 is performed, the system control part 4 at step S35 controls the printer unit drive part 6 so that the printer unit 10 performs the printing of the back-side of the second copy.

As described above, by performing the interleave printing procedure of FIG. 4 with the printing apparatus 2, an alternate double-side printing of plural copies is performed for the front side of the first copy, the front side of the second copy, the back side of the first copy, the back side of the second copy, etc., in this sequence. In the present embodiment, during the printing of the front side of the first copy, the print data is expanded to image data for the front side of the second copy and the image data is stored in the external storage part 8. During the printing of the front side of the second copy, the print data is expanded to image data for the back side of the second copy and the image data is stored in the external storage part 4.

In the above-described procedure of FIG. 4, the interleave printing of the first and second copies is explained as an example. However, the double-side printing control method of the present invention is not limited to this embodiment, and it is applicable to the interleave printing of three or more copies by taking account of a relationship between the speed of the expansion of the print data at the given resolution and the speed of the interleave printing.

It is possible for the above-described procedure of FIG. 4 to achieve an efficient, speedy printing when a processing time for the execution of the normal double-side printing (or the detected time count) is larger than a processing time for the execution of the interleave printing (or the reference time count).

Further, the present invention is not limited to the above-described embodiments, and variations and modifications may be made without departing from the scope of the present invention.

The present invention is based on Japanese priority application No.10-021022, filed on Feb. 2, 1998, the entire contents of which are hereby incorporated by reference.

What is claimed is:

1. A double-side printing control method executed by a printing apparatus including a system control part and an external storage part, the method comprising the steps of:

receiving a printing request transmitted by a host computer, the printing request including print data and a given resolution of the print data;

expanding the print data to image data at the given resolution;

storing the image data in the system control part;

performing a double-side printing with the stored image data when the printing request is a double-side printing request;

determining, before performing the double-side printing at the given resolution, whether an image memory area of the system control part that stores two pages of image data is held; and determining, before performing the double-side printing at the given resolution, whether an image memory area of the external storage part that stores one page of image data can be held.

2. The method according to claim 1, further comprising the step of changing the given resolution to a lower resolution or changing a double-side printing mode of the printing apparatus to a single-side printing mode when only an image memory area of the system control part storing one page of image data is held and an image memory area of the external storage part storing one page of image data cannot be held.

3. The method according to claim 1, further comprising the step of performing an interleave printing of plural copies when a processing time for the execution of the double-side printing is larger than a processing time for the execution of the interleave printing.

4. The method according to claim 1, wherein the double-side printing is performed at the given resolution when the system control part determines that the image memory area of the system control part that stores two pages of image data is not held but the image memory area of the external storage part that stores one page of image data can be held.

5. The method according to claim 2, wherein, when the system control part determines that the printing apparatus is currently set in the double-side printing mode, the double-side printing mode is changed to the single-side printing mode, and when the system control part determines that the printing apparatus is currently set in the single-side printing mode, the given resolution is changed to a lower resolution.

6. The method according to claim 3, wherein the printing apparatus includes a printer unit capable of performing an interleave printing procedure.

7. The method according to claim 3, further comprising the step of determining whether the interleave printing is performed based on a time count needed to expand the print data to image data at the given resolution.

* * * * *